US009824636B2

(12) United States Patent
Lu et al.

(10) Patent No.: US 9,824,636 B2
(45) Date of Patent: Nov. 21, 2017

(54) DISPLAY DEVICE AND METHOD OF ADJUSTING BACKLIGHT BRIGHTNESS OF DISPLAY DEVICE

(71) Applicants: BOE Technology Group Co., Ltd., Beijing (CN); Beijing BOE Optoelectronics Technology Co., Ltd., Beijing (CN)

(72) Inventors: Pengcheng Lu, Beijing (CN); Zhongjun Chen, Beijing (CN); Xue Dong, Beijing (CN); Renwei Guo, Beijing (CN); Peng Liu, Beijing (CN); Mubing Li, Beijing (CN); Jinghua Miao, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 54 days.

(21) Appl. No.: 14/743,490

(22) Filed: Jun. 18, 2015

(65) Prior Publication Data

US 2016/0225323 A1 Aug. 4, 2016

(30) Foreign Application Priority Data

Feb. 4, 2015 (CN) ..... 2015 1 0059648

(51) Int. Cl.
*G09G 3/34* (2006.01)

(52) U.S. Cl.
CPC ... *G09G 3/3406* (2013.01); *G09G 2320/0242* (2013.01); *G09G 2320/0626* (2013.01);
(Continued)

(58) Field of Classification Search
CPC ..... G09G 2320/0646; G09G 2360/16; G09G 3/3413; G09G 2340/06; G09G 2300/0452;
(Continued)

(56) References Cited

U.S. PATENT DOCUMENTS 9,462,243 B2 * 10/2016 Lin ..... H04N 9/3182
9,501,983 B2 * 11/2016 Tatsuno ..... G09G 3/3607
(Continued)

FOREIGN PATENT DOCUMENTS

CN 1637834 A 7/2005
CN 101887681 A 11/2010
CN 102122501 A 7/2011

OTHER PUBLICATIONS

Jun. 27, 2016—(CN)—First Office Action 201510059648.0 with English Tran.

*Primary Examiner* — Jose Soto Lopez
(74) *Attorney, Agent, or Firm* — Banner & Witcoff, Ltd.

(57) ABSTRACT

A display device and a method of adjusting backlight brightness of the display device are provided. The method includes converting original RGB signals of each pixel to corresponding RGBW signals; determining the color and original brightness value of each pixel based on the gray value ratio of the original RGB signals of each pixel; determining the backlight brightness value of each pixel based on the color of each pixel after the original RGB signals being converted; and performing weighted average calculation on the backlight brightness values of each pixel after the signals being converted, so as to obtain a whole backlight brightness adjustment value of all pixels.

15 Claims, 2 Drawing Sheets

(52) U.S. Cl.
CPC ... *G09G 2330/021* (2013.01); *G09G 2340/06* (2013.01); *G09G 2360/16* (2013.01)

(58) Field of Classification Search
CPC ..... G09G 2320/0666; G09G 3/3607; G09G 2320/0242; G09G 3/3406; G09G 2320/0626; G09G 3/2003; G09G 2320/062; G09G 2320/0633; G09G 2330/021
See application file for complete search history.

(56) References Cited

U.S. PATENT DOCUMENTS 9,502,001 B2 * 11/2016 Xu ..... G09G 5/10
9,524,682 B2 * 12/2016 El-Ghoroury ..... G09G 3/3607
9,570,015 B2 * 2/2017 Yang ..... G09G 3/2096
2004/0008177 A1 * 1/2004 Ahn ..... G09G 3/3406 345/102
2005/0248524 A1 * 11/2005 Feng ..... G09G 3/3413 345/102
2007/0216636 A1 * 9/2007 Lo ..... G09G 3/3406 345/102
2007/0279372 A1 * 12/2007 Elliott ..... G09G 3/3426 345/102
2008/0088572 A1 * 4/2008 Wang ..... G09G 3/3426 345/102
2008/0309603 A1 * 12/2008 Feng ..... G09G 3/3648 345/89
2009/0085847 A1 * 4/2009 Morisue ..... G09G 3/3406 345/88
2009/0160747 A1 * 6/2009 Morisue ..... G09G 3/3406 345/88
2009/0189842 A1 * 7/2009 Huang ..... G09G 3/342 345/102
2009/0207182 A1 * 8/2009 Takada ..... G09G 3/3406 345/589
2009/0231467 A1 * 9/2009 Yamashita ..... G03B 7/091 348/234
2010/0013872 A1 * 1/2010 Masuda ..... G09G 3/3413 345/691
2010/0259556 A1 * 10/2010 Inuzuka ..... G09G 3/3611 345/604
2010/0309107 A1 * 12/2010 Muroi ..... G02F 1/133603 345/88
2010/0321414 A1 * 12/2010 Muroi ..... G09G 3/3413 345/690
2011/0050937 A1 * 3/2011 Huang ..... G03B 15/03 348/222.1
2011/0090265 A1 * 4/2011 Muroi ..... G09G 3/3413 345/690
2011/0109658 A1 * 5/2011 Park ..... G09G 3/3406 345/690
2011/0279710 A1 * 11/2011 Lee ..... H04N 5/2351 348/234
2012/0001553 A1 * 1/2012 Fletcher ..... G06F 1/1662 315/157
2012/0001947 A1 * 1/2012 Chu-Ke ..... G09G 3/3406 345/690
2012/0056907 A1 * 3/2012 Lee ..... G09G 3/3426 345/690
2012/0081407 A1 * 4/2012 Chiou ..... G09G 3/3406 345/690
2012/0112991 A1 * 5/2012 Hashimoto ..... G09G 3/3413 345/89
2012/0113153 A1 * 5/2012 Casner ..... G02B 27/2214 345/690
2012/0120096 A1 * 5/2012 Johnson ..... G09G 3/2048 345/596
2012/0249610 A1 * 10/2012 Katagami ..... G09G 3/3426 345/690
2013/0215360 A1 * 8/2013 Pollack ..... G09G 3/3413 349/61
2014/0253609 A1 * 9/2014 Wan ..... G09G 3/3413 345/690
2014/0333683 A1 * 11/2014 Qi ..... G09G 3/3233 345/690
2015/0235597 A1 * 8/2015 Meng ..... F21V 9/10 345/102
2015/0325175 A1 * 11/2015 Yamaguchi ..... G09G 3/3413 345/690
2015/0348506 A1 * 12/2015 Ooga ..... G09G 5/10 345/205
2015/0371593 A1 * 12/2015 Hesselmark ..... G09G 3/3413 345/440
2016/0247295 A1 * 8/2016 Rasmusson ..... G09G 3/3413
2016/0267874 A1 * 9/2016 Chen ..... G09G 5/02
2016/0322004 A1 * 11/2016 Yashiki ..... G09G 3/3426

* cited by examiner

DISPLAY DEVICE AND METHOD OF ADJUSTING BACKLIGHT BRIGHTNESS OF DISPLAY DEVICE

This application claims priority to Chinese Patent Application No. 201510059648.0 filed on Feb. 4, 2015. The present application claims priority to and the benefit of the above-identified application and is incorporated herein in its entirety.

TECHNICAL FIELD

Embodiments of the present invention relate to a display device and a method of adjusting backlight brightness of the display device.

BACKGROUND

With the development of mobile communication technology, mobile phones have become very popular, and with the rapid development of mobile terminal technology and application, functions of the mobile phone have become increasingly rich, power consumption of the mobile phone is increased rapidly, and battery life of the mobile phone is correspondingly reduced. As an important portion of the mobile phone power consumption, the backlight power consumption is attracting more and more attention, and now dynamic backlight adjustment technology is the most frequently used technology for reducing backlight power consumption.

SUMMARY

At least one embodiment of the present invention provides a method of adjusting backlight brightness of a display device, the method includes: converting original RGB signals of each pixel to corresponding RGBW signals; determining a color and original brightness value of each pixel based on a gray value ratio of the original RGB signals of each pixel; determining a backlight brightness value of each pixel based on the color of each pixel after the original RGB signals being converted; performing weighted average calculation on the backlight brightness values of all pixels after the signals being converted, so as to obtain the whole backlight brightness adjustment value of the pixels.

Embodiments of the present invention also provide a display device, the display device includes a signal decomposition unit, a backlight drive unit and a backlight control unit.

The signal decomposition unit is configured to convert original RGB signals of each pixel to corresponding RGBW signals;

The backlight drive unit is configured to determine a color and original brightness value of each pixel based on a gray value ratio of original RGB signals of each pixel, determine a backlight brightness value of each pixel based on the color of each pixel after the original RGB signals being converted; and perform weighted average calculation on the backlight brightness values of all pixels after the signals being converted, so as to obtain the whole backlight brightness adjustment value of the pixels.

The backlight control unit is configured to receive the whole backlight brightness adjustment value calculated by the backlight drive unit, and adjust the whole backlight brightness by controlling a duty ratio of pulse width modulation signal of a backlight source.

BRIEF DESCRIPTION OF THE DRAWINGS

Embodiments of the present disclosure will be described in detail hereinafter in conjunction with accompanying drawings to allow one of ordinary skill in the art to understand the present disclosure more clearly, in which.

DETAILED DESCRIPTION

The technical solutions provided in the embodiments of the present invention will be described clearly and completely as below in conjunction with the accompanying drawings of embodiments of the present invention. It is apparent that the described embodiments are only a part of but not all of exemplary embodiments of the present invention. Based on the described embodiments of the present invention, various other embodiments and variants can be obtained by a person of ordinary skill in the art without creative labor and those embodiments and variants shall fall into the protection scope of the present invention.

Unless otherwise defined, all the technical and scientific terms used herein have the same meanings as commonly understood by one of ordinary skill in the art to which the present invention belongs. The terms, such as "first," "second" or the like, which are used in the description and the claims of the present application, are not intended to indicate any sequence, amount or importance, but for distinguishing various components. Also, the terms, such as "a/an," "one," "the/said" or the like, are not intended to limit the amount, but for indicating the existence of at least one. The terms, such as "comprise/comprising," "include/including" or the like, are intended to specify that the elements or the objects stated before these terms encompass the elements or the objects and equivalents thereof listed after these terms, but not preclude other elements or objects.

The inventor notice that a typical dynamic backlight adjustment technology directly outputs picture information to a display screen and adjusts backlight brightness, after gathering luminance and gray information statistics simply based on the content of a picture.

Although this adjustment method can reduce power consumption by properly changing the backlight brightness, since an approximate adjustment value is roughly given only based on the gray information statistical values of the picture, it cannot generate an accurate ratio as the reference value of backlight brightness adjustment, and it cannot clearly calculate the specific data of the duty ratio of pulse width modulation signal, which needs to be adjusted, of the backlight source based on the specific content of the picture, thus it cannot achieve the purpose of precise adjustment, and there are still a certain degree of backlight brightness waste.

Embodiments of the present invention provide a display device and a method of adjusting backlight brightness of the display device. The method gives a specific adjustment value for brightness of each pixel so that the backlight brightness is precisely adjusted, which overcomes the roughness of adjusting the backlight brightness in the prior art, further saving the backlight brightness.

Embodiment 1

Figure 1:
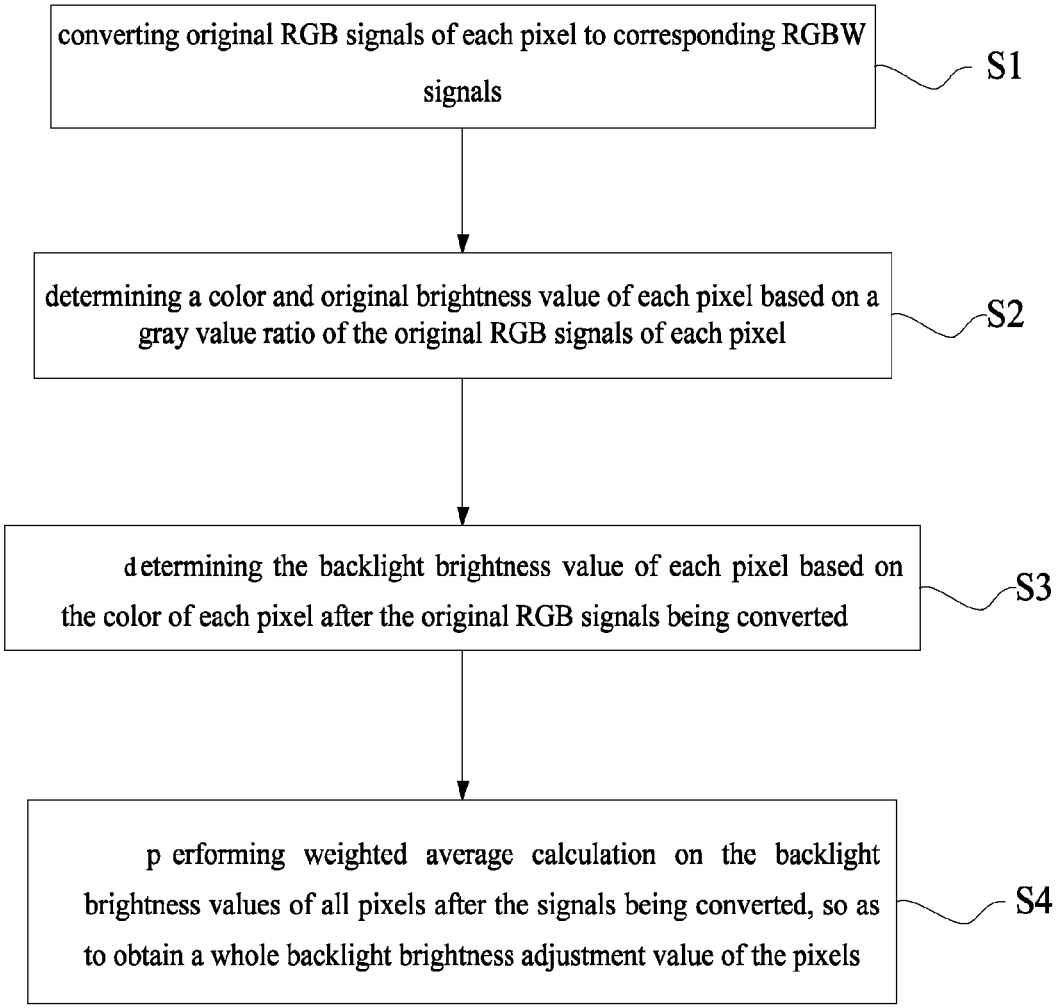
FIG. 1 is a flow diagram of a method of adjusting backlight brightness of a display device according to Embodiment 1.

As shown in FIG. 1, the embodiment of the present invention provides a method of adjusting backlight brightness of the display device. The method includes: converting original RGB signals of each pixel to corresponding RGBW signals; determining the color and original brightness value of each pixel based on the gray value ratio of the original RGB signals of each pixel; determining the backlight brightness value of each pixel based on the color of each pixel after the original RGB signals being converted; performing weighted average calculation on the backlight brightness values of all pixels after the signals being converted, so as to obtain a whole backlight brightness adjustment value of the pixels.

The method of adjusting backlight brightness of the display device in the embodiment gives a specific adjustment value for brightness of each pixel so that the backlight brightness is precisely adjusted, which overcomes the roughness of adjusting the backlight brightness in the prior art, thereby further saving the backlight brightness.

For example, the method includes the following steps.

S1: the original RGB signals of each pixel are converted to the corresponding RGBW signals. The converting method can use various method in the art to perform conversion, which is not repeated herein.

S2: the color and original brightness value of each pixel are determined based on the gray value ratio of the original RGB signals of each pixel, which includes following situations.

if the gray value ratio of the RGB signals of a pixel is R:G:B=X:0:0, it is determined that a sub-pixel R in the pixel is lighted, the color of the pixel is pure red R; and the original brightness value of the pixel is calculated and stored;

if the gray value ratio of the RGB signals of a pixel is R:G:B=0:Y:0, it is determined that a sub-pixel G in the pixel is lighted, the color of the pixel is pure green G; and the original brightness value of the pixel is calculated and stored;

if the gray value ratio of the RGB signals of a pixel is R:G:B=0:0:Z, it is determined that a sub-pixel B in the pixel is lighted, the color of the pixel is pure blue B; and the original brightness value of the pixel is calculated and stored;

if the gray value ratio of the RGB signals of a pixel is R:G:B=0:Y:Z, it is determined that sub-pixels G and B in the pixel are lighted, the color of the pixel is cyan C; and the original brightness value of the pixel is calculated and stored;

if the gray value ratio of the RGB signals of a pixel is R:G:B=X:0:Z, it is determined that sub-pixels R and B in the pixel are lighted, the color of the pixel is magenta M; and the original brightness value of the pixel is calculated and stored;

if the gray value ratio of the RGB signals of a pixel is R:G:B=X:Y:0, it is determined that sub-pixels R and G in the pixel are lighted, the color of the pixel is yellow Y; and the original brightness value of the pixel is calculated and stored;

if the gray value ratio of the RGB signals of a pixel is R:G:B=255:255:255, it is determined that sub-pixels R, G and B in the pixel are lighted, the color of the pixel is white W; and the original brightness value of the pixel is calculated and stored;

if the gray value ratio of the RGB signals of a pixel is R:G:B=1:1:1 and each of gray values is less than 255, it is determined that sub-pixels R, G and B in the pixel are lighted, the color of the pixel is gray; and the original brightness value of the pixel is calculated and stored; and if the gray value ratio of the RGB signals of a pixel does not fall into above situations, it is determined that sub-pixels R, G and B in the pixel are lighted, the color of the pixel is other color; and the original brightness value of the pixel is calculated and stored; where each of X, Y and Z is an integer which is greater than or equal to 1 and is less than or equal to 255.

The above situations determine the colors of pixels corresponding to RGB signals in the specific frame image information and determine the original brightness value of the pixel.

It should be understood that when the original RGB signals are converted to RGBW signals, the actual corresponding light-emitting area of pixel in the display panel is not changed, and only the number of sub-pixels is increased from 3 (R, G, B) to 4 (R, G, B, W).

It should be understood that the original RGB signals of a pixel can be calculated by using brightness algorithm to obtain the corresponding original brightness value of the pixel.

For example, the brightness algorithm can use the following formula:

$Y=(2R+5G+B)/8$, where $Y$ represents brightness value, $R,G,B$ respectively represent $R,G,B$ gray value of original $RGB$ signals.

It should be understood that it can use other brightness algorithms.

S3: the backlight brightness value of each pixel is determined based on the color of each pixel after the original RGB signals being converted.

The above nine situations can be divided into three types according to different colors.

For example, 1. The original brightness value of the pixel is increased by 1/12.

The original brightness values of pixels which are pure red R, pure green G and pure blue B are read, and the original brightness values are increased by 1/12 to act as the adjusted brightness values.

The pixel brightness is usually proportional to the light-emitting area of the pixel. For example, the backlight brightness is the same, and LCD deflection is the same.

After the original RGB signals are converted to RGBW signals, the light-emitting area of a single pixel is reduced from initial 1/3 to 1/4, and the corresponding light-emitting brightness is also reduced by $1/3-1/4=1/12$ compared to the backlight brightness of original RGB signals.

2. The original brightness value of pixel is increased by 1/6.

The original brightness values of pixels which are pure red R, pure green G and pure blue B are read, and the original brightness values are increased by 1/12 to act as the adjusted brightness values.

The pixel brightness is usually proportional to the light-emitting area of the pixel. For example, the backlight brightness is the same, and LCD deflection is the same.

After the original RGB signals are converted to RGBW signals, the light-emitting area of a single pixel is reduced from initial 2/3 to 1/2, and the corresponding light-emitting brightness is also reduced by $2/3-1/2=1/6$ compared to the backlight brightness of original RGB signals. Therefore, the backlight brightness needs to be increased by 1/6.

3. The original brightness value of pixel is remained unchanged.

The original brightness values of pixels which are white W, gray and other color are read, and the original brightness values are remained unchanged to act as the adjusted brightness values.

After the original RGB signals are converted to RGBW signals, the light-emitting area of a single pixel is remained unchanged, that is all of the sub-pixels emit light. Therefore, the backlight brightness does not need to be adjusted.

Therefore, the brightness values of corresponding pixels in a given frame of an image are precisely adjusted.

S4: the whole backlight brightness adjustment values of all pixels are obtained by performing weighted average calculation on the backlight brightness values of the pixels resulted before and after the signals being converted.

In this way, all of pixels in the given frame of image have precise whole backlight brightness adjustment values. Therefore, the backlight brightness can be precisely adjusted by controlling the backlight source, for example, controlling the duty ratio pulse width modulation signal of the LED.

The adjustment of the backlight brightness is more precise, and can further save backlight brightness and reduce energy consumption, compared to statistical gray values of original RGB signals.

Embodiment 2

Figure 2:
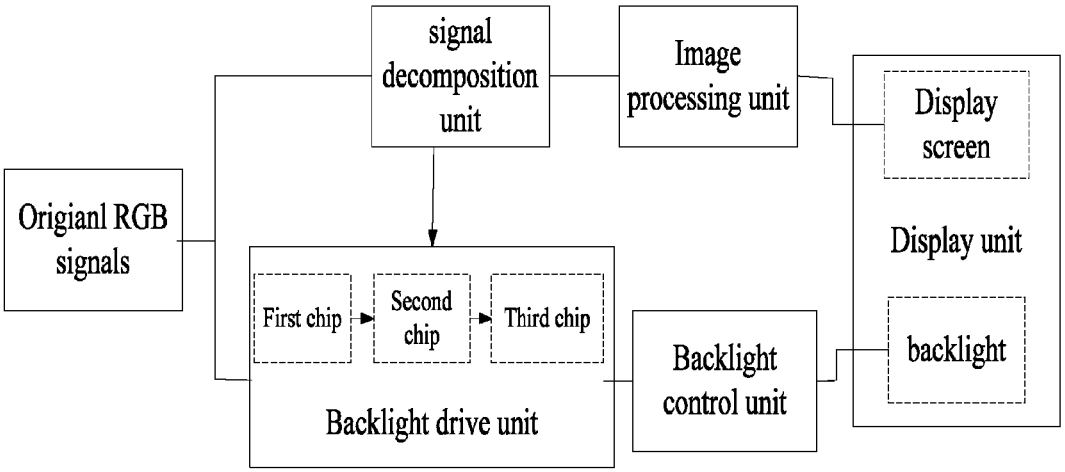
FIG. 2 is a flow diagram of signal process in a part of units in a display device according to Embodiment 2.

As shown in FIG. 2, the embodiment provides a display device. The display device includes a signal decomposition unit, a backlight drive unit and a backlight control unit.

The signal decomposition unit is configured to convert original RGB signals of each pixel to corresponding RGBW signals.

The video signal conversion method of each frame image can use various algorithms in the art.

A portion or component of the converted RGBW signals by the signal decomposition unit is transmitted to an image processing unit, and is processed by the image processing unit and transmitted to a display screen of a display unit to display the image. The processing method of the above image processing belongs to prior art, which is not repeated herein.

Another portion of the converted RGBW signal by the signal decomposition unit is transmitted to the backlight drive unit.

The backlight drive unit is configured to determine the color and original brightness value of each pixel based on the gray value ratio of original RGB signals of each pixel, determine the backlight brightness value of each pixel based on the color of each pixel after the original RGB signals being converted; and perform weighted average calculation on the backlight brightness values of all pixels to obtain a whole backlight brightness adjustment value of the pixels resulted before and after the signals being converted.

For example, the backlight drive unit includes a first chip, which is configured to determine and store the color of each pixel, and calculate and store original brightness value of each pixel based on the gray value ratio of original RGB signals of each pixel. It includes the following situations.

if the gray value ratio of the RGB signals of a pixel is R:G:B=X:0:0, it is determined that a sub-pixel R in the pixel is lighted, the color of the pixel is pure red R; and the original brightness value of the pixel is calculated and stored;

if the gray value ratio of the RGB signals of a pixel is R:G:B=0:Y:0, it is determined that a sub-pixel G in the pixel is lighted, the color of the pixel is pure green G; and the original brightness value of the pixel is calculated and stored;

if the gray value ratio of the RGB signals of a pixel is R:G:B=0:0:Z, it is determined that a sub-pixel B in the pixel is lighted, the color of the pixel is pure blue B; and the original brightness value of the pixel is calculated and stored;

if the gray value ratio of the RGB signals of a pixel is R:G:B=0:Y:Z, it is determined that sub-pixels G and B in the pixel are lighted, the color of the pixel is cyan C; and the original brightness value of the pixel is calculated and stored;

if the gray value ratio of the RGB signals of a pixel is R:G:B=X:0:Z, it is determined that sub-pixels R and B in the pixel are lighted, the color of the pixel is magenta M; and the original brightness value of the pixel is calculated and stored;

if the gray value ratio of the RGB signals of a pixel is R:G:B=X:Y:0, it is determined that sub-pixels R and G in the pixel are lighted, the color of the pixel is yellow Y; and the original brightness value of the pixel is calculated and stored;

if the gray value ratio of the RGB signals of a pixel is R:G:B=255:255:255, it is determined that sub-pixels R, G and B in the pixel are lighted, the color of the pixel is white W; and the original brightness value of the pixel is calculated and stored;

if the gray value ratio of the RGB signals of a pixel is R:G:B=1:1:1 and each of gray values is less than 255, it is determined that sub-pixels R, G and B in the pixel are lighted, the color of the pixel is gray; and the original brightness value of the pixel is calculated and stored; and if the gray value ratio of the RGB signals of a pixel does not fall into above situations, it is determined that sub-pixels R, G and B in the pixel are lighted, the color of the pixel is other color; and the original brightness value of the pixel is calculated and stored; where each of X, Y and Z is an integer greater than or equal to 1 and is less than or equal to 255.

It should be understood that the original RGB signals of a pixel can be calculated by using brightness algorithm to obtain the corresponding original brightness value of the pixel. For example, the brightness algorithm can use the following formula:

$Y=(2R+5G+B)/8$, where $Y$ represents brightness value, $R,G,B$ respectively represent $R,G,B$ gray value of original $RGB$ signals.

The backlight drive unit can include a second chip, which is configured to read original brightness values of pixels which are pure red R, pure green G and pure blue B in the first chip, and increase the original brightness values by 1/12 to act as the adjusted brightness values; read original brightness values of pixels which are cyan C, magenta M and yellow Y, and increase the original brightness values by 1/6 to act as the adjusted brightness values; and read original brightness values of pixels which are white W, gray and other color, and remain the original brightness values unchanged to act as the adjusted brightness values.

The backlight drive unit can include a third chip, which is configured to read the backlight brightness values of each pixel in the second chip after the signals being converted, and perform weighted average calculation on the backlight brightness values of all pixels, so as to obtain a whole backlight brightness adjustment value of the pixels.

The backlight control unit is configured to receive the whole backlight brightness adjustment value calculated by the backlight drive unit, and adjust the whole backlight brightness by controlling the duty ratio of pulse width modulation signal of the backlight source.

It should be understood that the described above are only illustrative embodiments and implementations for explaining the principles of the present invention, and the present invention is not intended to be limited thereto. For one of ordinary skill in the art, various modifications and improvements may be made without departing from the spirit and scope of embodiments of the present invention, and all of which should fall within the protection scope of the present invention. The scope protected by the present invention is defined by the claims.

The present invention claims priority of Chinese patent application No. 201510059648.0 filed on Feb. 4, 2015 titled "a display device and a method of adjusting backlight brightness of the display device", the whole contents of which are incorporated herein by reference.

What is claimed is:

1. A method of adjusting backlight brightness of a display device, comprising:

converting original RGB signals of each pixel to corresponding RGBW signals;

determining an original brightness value of each pixel based on a gray value ratio of the original RGB signals of each pixel;

determining a backlight brightness value of each pixel based on a color of each pixel after the original RGB signals being converted, wherein the backlight brightness value of each pixel is the same as the original brightness value of the pixel only if all components of the gray value ratio of the RGB signals of the pixel have non-zero values or if none of the components of the gray value ratio of the RGB signals of the pixel have a non-zero value; and performing a weighted average calculation on the backlight brightness values of all pixels after the signals being converted, so as to obtain a whole backlight brightness adjustment value of the pixels.

2. The method of adjusting backlight brightness according to claim 1, wherein the determining of the original brightness value of each pixel based on the gray value ratio of the original RGB signals of each pixel comprises:

if one component of the gray value ratio of the original RGB signals of a pixel is nonzero, it is determined that one sub-pixel in the pixel is lighted; and the original brightness value of the pixel is calculated and stored;

if two components of the gray value ratio of the original RGB signals of a pixel are nonzero, it is determined that two sub-pixels in the pixel are lighted; and the original brightness value of the pixel is calculated and stored; and if three components of the gray value ratio of the original RGB signals of a pixel are nonzero, it is determined that three sub-pixels in the pixel are lighted; and the original brightness value of the pixel is calculated and stored.

3. The method of adjusting backlight brightness according to claim 1, further comprising: reading original brightness values of any pixels having one non-zero value among components of the gray value ratio of the RGB signals, and increasing the original brightness values by 1/12 to act as the backlight brightness values corresponding to those pixels.

4. The method of adjusting backlight brightness according to claim 1, further comprising: reading original brightness values of any pixels having two non-zero values among components of the gray value ratio of the RGB signals, and increasing the original brightness values by 1/6 to act as the backlight brightness values corresponding to those pixels.

5. The method of adjusting backlight brightness according to claim 2, further comprising: reading original brightness values of any pixels having one non-zero value among components of the gray value ratio of the RGB signals, and increasing the original brightness values by 1/12 to act as the backlight brightness values corresponding to those pixels.

6. The method of adjusting backlight brightness according to claim 2, further comprising: reading original brightness values of any pixels having two non-zero values among components of the gray value ratio of the RGB signals, and increasing the original brightness values by 1/6 to act as the backlight brightness values corresponding to those pixels.

7. The method of adjusting backlight brightness according to claim 3, further comprising: reading original brightness values of any pixels having two non-zero values among components of the gray value ratio of the RGB signals, and increasing the original brightness values by 1/6 to act as the backlight brightness values corresponding to those pixels.

8. The method of adjusting backlight brightness according to claim 5, further comprising: reading original brightness values of any pixels having two non-zero values among components of the gray value ratio of the RGB signals, and increasing the original brightness values by 1/6 to act as the backlight brightness values corresponding to those pixels.

9. A display device, comprising:

a signal decomposition unit configured to convert original RGB signals of each pixel to corresponding RGBW signals;

a backlight drive unit configured to determine an original brightness value of each pixel based on a gray value ratio of the original RGB signals of each pixel, determine a backlight brightness value of each pixel based on a color of each pixel after the original RGB signals being converted; and perform a weighted average calculation on the backlight brightness values of all pixels after the signals being converted, so as to obtain a whole backlight brightness adjustment value of the pixels; and a backlight control unit configured to receive the whole backlight brightness adjustment value calculated by the backlight drive unit, and adjust the whole backlight brightness by controlling a duty ratio of a pulse width modulation signal of a backlight source, wherein the backlight drive unit includes a first chip and a second chip, the first chip being configured to determine and store the color of each pixel, and calculate and store the original brightness value of each pixel based on the gray value ratio of the original RGB signals of each pixel, and the second chip being configured to use the original brightness values as the backlight brightness values only for pixels having non-zero values in all components of the gray value ratio of the RGB signals or having zero values in all components of the gray value ratio of the RGB signals.

10. The display device according to claim 9, wherein the first chip is further configured to:

if one component of the gray value ratio of the original RGB signals of a pixel is nonzero, it is determined that one sub-pixel in the pixel is lighted; and the original brightness value of the pixel is calculated and stored;

if two components of the gray value ratio of the original RGB signals of a pixel are nonzero, it is determined that two sub-pixels in the pixel are lighted; and the original brightness value of the pixel is calculated and stored; and if three components of the gray value ratio of the original RGB signals of a pixel are nonzero, it is determined that three sub-pixels in the pixel are lighted; and the original brightness value of the pixel is calculated and stored.

11. The display device according to claim 9, wherein the second chip is further configured to:

read original brightness values of any pixels having one non-zero value among components of the gray value ratio of the RGB signals in the first chip, and increase the original brightness values by 1/12 to act as the backlight brightness values corresponding to those pixels; and read original brightness values of any pixels having two non-zero values among components of the gray value ratio of the RGB signals, and increase the original brightness values by 1/6 to act as the adjusted backlight values corresponding to those pixels.

12. The display device according to claim 9, the backlight drive unit further comprises a third chip, which is configured to read the backlight brightness values of each pixel in the second chip after the signals being converted, and perform the weighted average calculation on the backlight brightness values of all pixels, so as to obtain the whole backlight brightness adjustment value of the pixels.

13. The display device according to claim 10, the backlight drive unit further comprises a third chip, which is configured to read the backlight brightness values of each pixel in the second chip after the signals being converted, and perform the weighted average calculation on the backlight brightness values of all pixels, so as to obtain the whole backlight brightness adjustment value of the pixels.

14. The display device according to claim 11, the backlight drive unit further comprises a third chip, which is configured to read the backlight brightness values of each pixel in the second chip after the signals being converted, and perform the weighted average calculation on the backlight brightness values of all pixels, so as to obtain the whole backlight brightness adjustment value of the pixels.

15. A display device, comprising:

a signal decomposition unit configured to convert original RGB signals of each pixel to corresponding RGBW signals;

a backlight drive unit configured to determine an original brightness value of each pixel based on a gray value ratio of the original RGB signals of each pixel, determine a backlight brightness value of each pixel based on a color of each pixel after the original RGB signals being converted; and perform a weighted average calculation on the backlight brightness values of all pixels after the signals being converted, so as to obtain a whole backlight brightness adjustment value of the pixels; and a backlight control unit configured to receive the whole backlight brightness adjustment value calculated by the backlight drive unit, and adjust the whole backlight brightness by controlling a duty ratio of a pulse width modulation signal of a backlight source, wherein the backlight drive unit includes a first chip and a second chip, the first chip being configured to determine and store the color of each pixel, and calculate and store and the original brightness value of each pixel based on the gray value ratio of the original RGB signals of each pixel, and the second chip being configured to:

read original brightness values of any pixels having one non-zero value among components of the gray value ratio of the RGB signals in the first chip, and increase the original brightness values by 1/12 to act as the backlight brightness values corresponding to those pixels;

read original brightness values of any pixels having two non-zero values among components of the gray value ratio of the RGB signals, and increase the original brightness values by 1/6 to act as the backlight brightness values corresponding to those pixels; and read original brightness values of any pixels having non-zero values in all components of the gray value ratio of the RGB signals, and use the original brightness values as the backlight brightness values corresponding to those pixels.

* * * * *